US011199376B2

(12) United States Patent
Marshall

(10) Patent No.: US 11,199,376 B2
(45) Date of Patent: Dec. 14, 2021

(54) METHODS, SYSTEMS AND APPARATUS FOR SLING AND TRAP CAPTURE AND RAPID DEPLOYMENT

(71) Applicant: Dark Horse Solutions, LLC, Sandy, UT (US)

(72) Inventor: Bradley David Marshall, Sandy, UT (US)

(73) Assignee: Dark Horse Solutions, LLC, Sandy, UT (US)

( * ) Notice: Subject to any disclaimer, the term of this patent is extended or adjusted under 35 U.S.C. 154(b) by 0 days.

(21) Appl. No.: 16/672,155

(22) Filed: Nov. 1, 2019

(65) Prior Publication Data

US 2020/0149842 A1 May 14, 2020

Related U.S. Application Data

(60) Provisional application No. 62/766,907, filed on Nov. 13, 2018.

(51) Int. Cl.
*F41C 23/02* (2006.01)
*F41C 33/00* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02
USPC ..... 224/150
See application file for complete search history.

(56) References Cited

U.S. PATENT DOCUMENTS

| | | | | |
|---|---|---|---|---|
| 5,246,154 | A * | 9/1993 | Adams | A45F 3/14 224/150 |
| 7,841,496 | B1 * | 11/2010 | Schweikert | F41C 33/002 224/150 |
| 8,430,285 | B2 * | 4/2013 | Burnsed, Jr. | F41C 23/02 224/150 |
| 9,528,795 | B1 * | 12/2016 | Burnsed, Jr. | F41C 23/02 |
| 10,724,827 | B2 * | 7/2020 | Brock | F41C 33/001 |
| 2002/0020724 | A1 * | 2/2002 | Lindsey | F41C 33/002 224/150 |
| 2006/0011677 | A1 * | 1/2006 | Burnsed | F41C 33/001 224/150 |

(Continued)

OTHER PUBLICATIONS

G-HOOK: Edge Works, https://web.archive.org/web/20170910094657/https://www.tacticalholsters.com/product/g-hook/, pp. 1-2, Sep. 10, 2017.

*Primary Examiner* — Peter N Helvey
(74) *Attorney, Agent, or Firm* — Bretton L. Crockett; TechLaw Ventures, PLLC

(57) ABSTRACT

This disclosure extends to systems, apparatus, and methods for the rapid deployment of a sling or strap on a rifle, firearm, tool, or implement from a storage mode to a deployment mode in a reliable and repeatable manner, while minimizing snagging, binding or tangling during storage or transport. In one exemplary system in accordance with the teachings of the present disclosure, a capture device may include a single closed loop interface adjacent to an open interface. A first strap may be looped through the closed interface and secured therein. Another portion of the sling system, such as a loop of strap or webbing may be secured by tensioning in the open interface to tightly secure the system against the rifle or tool in a secured position. By slightly loosening the loop, the secured portion can exit the open interface rapidly as the sling is deployed.

9 Claims, 3 Drawing Sheets

(56) References Cited

U.S. PATENT DOCUMENTS

| | | | | |
|---|---|---|---|---|
| 2007/0278262 | A1* | 12/2007 | Gallagher | F41C 33/002 224/150 |
| 2008/0217371 | A1* | 9/2008 | Wemmer | F41C 33/00 224/579 |
| 2009/0321484 | A1* | 12/2009 | Schweikert | F41C 33/002 224/268 |
| 2011/0017788 | A1* | 1/2011 | Haley | F41C 33/002 224/150 |
| 2011/0186603 | A1* | 8/2011 | Alford | F41C 33/002 224/150 |
| 2016/0265873 | A1 | 9/2016 | Schuman et al. | |
| 2020/0041227 | A1* | 2/2020 | Brock | F41C 33/002 |

* cited by examiner

METHODS, SYSTEMS AND APPARATUS FOR SLING AND TRAP CAPTURE AND RAPID DEPLOYMENT

CROSS-REFERENCE TO RELATED APPLICATION

This application claims the benefit of U.S. Provisional Patent Application No. 62/766,907 filed on Nov. 13, 2018, which is incorporated by reference herein in its entirety, including but not limited to those portions that specifically appear hereinafter, the incorporation by reference being made with the following exception: In the event that any portion of the above-referenced application is inconsistent with this application, this application supersedes said above-referenced application.

BACKGROUND

The disclosure relates generally to methods, systems, and devices for management and storage of slings for rifle or weapons. During storage, transport and deployment such slings, straps or tethers can become tangled, or snagged in packs, gear, clothing or vehicles, etc. In a situation requiring rapid deployment, even the short delay of resolving such a tangle can be a serious issue for a responding officer or soldier.

Some current approaches to securing slings utilize elastic bands, sewn elastic bands of rubber, or other synthetic elastic material, all of which suffer from gradual loss of tension, UV sensitivity and chemical resistance. Such elastic bands may also fail to secure the sling, strap or tether in flat, tight profile against the weapon or tool in a manner that provides an optimal profile to reduce or eliminate snagging.

A system or apparatus that provides a way to secure the sling or strap that is attached to the rifle, firearm, tool or other implement in a manner that can be used to keep it close to the body and prevents it from becoming tangled or snagged, and, facilitates rapid deployment from the secured position to repeatable use positions, while not encumbering or negatively affecting the normal operation of the sling, strap or tether would be an improvement in the art. Such a system that, when deployed, stays in place and does not suffer from the slipping, sliding and random mis-adjustment that other sling and strap buckle and adjustments systems often suffer from would be a further improvement in the art.

SUMMARY

Systems and apparatus in accordance with the present disclosure allow for the rapid deployment of a sling or strap on a rifle, firearm, tool, or implement from a storage mode to a deployment mode in a reliable and repeatable manner, while minimizing snagging, binding or tangling during storage or transport. In one exemplary system in accordance with the teachings of the present disclosure, a capture device may include a single closed loop interface adjacent to an open interface. A first strap may be looped through the closed interface and secured therein. Another portion of the sling system, such as a loop of strap or webbing may be secured by tensioning in the open interface to tightly secure the system against the rifle or tool in a secured position. By slightly loosening the loop, the secured portion can exit the open interface rapidly as the sling is deployed.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base, or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

The disclosure extends to methods, systems, and devices for the rapid deployment of a sling or strap on a rifle, firearm, tool, or implement from a storage mode to a deployment mode. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms “a,” “an,” and “the” include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

Figure 1A:
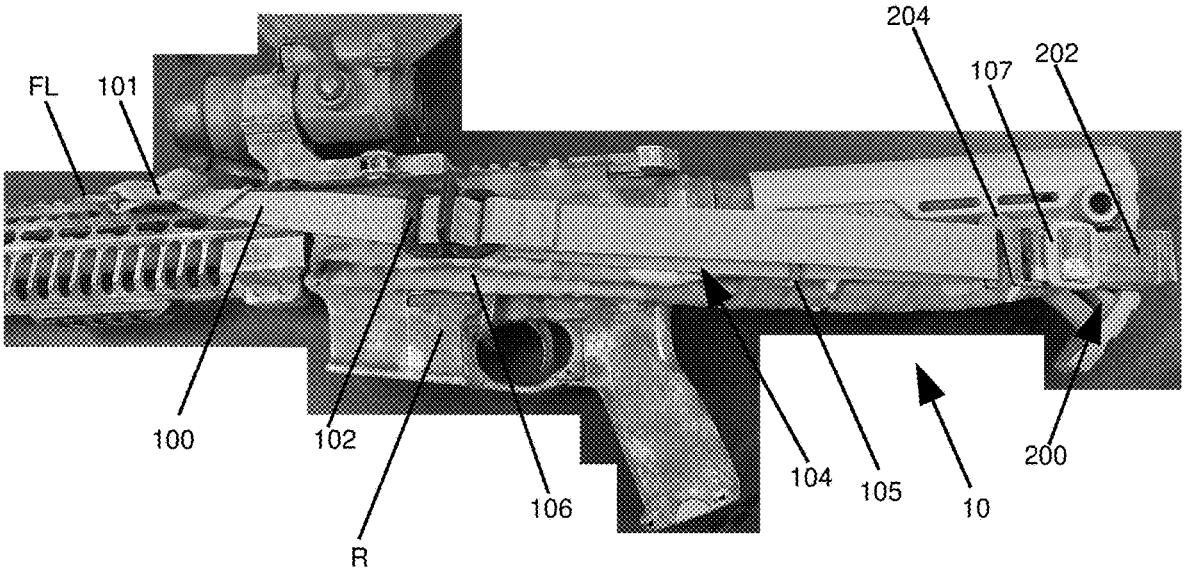
FIG. 1A illustrates a side view of a rifle with a sling system made in accordance with the teachings and principles of the disclosure attached thereto in a secured position.
Figure 1B:
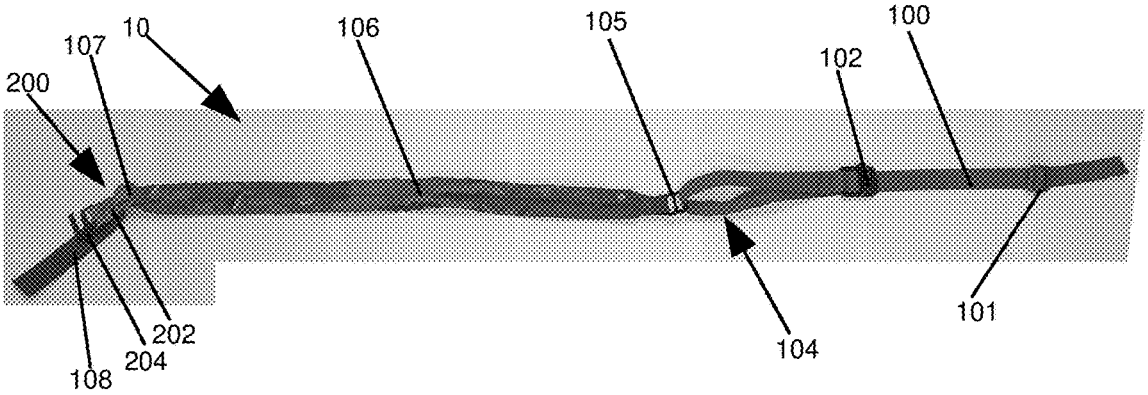
FIG. 1B illustrates the sling system of FIG. 1A in isolation.

A first example of an embodiment of a sling system 10 in accordance with the teachings of the present disclosure is depicted in FIG. 1A, in a secured position on a rifle R, and in isolation in FIG. 1B. A front strap 100, which may be formed from webbing, strapping, or tether material, as known to those of skill in the art is disposed at a first end of the system 10. The front strap may be used to secure the system to a rifle R at a first end, as by insertion in a structure, such as a loop FL, or other mounting structure, on the rifle R and secured back to itself using a strap slide 101 or other structure.

An adjustable loop 104 of the strapping material may be defined by a loop structure 105 through which the strap may easily slide and a quick adjustment mechanism, such as a speed buckle 102, that slides on the strap for defining the size of the adjustable loop 104. In the depicted embodiment, the speed buckle 102 may be formed as a slide having a generally planar base with two parallel large ports through which the strap can easily slide and an outwardly extending handle allowing the speed buckle to be easily manipulated for movement.

In the depicted embodiment, the loop structure 105 provides an attachment to a linear section 106, which may be a padded shoulder contacting portion. At an opposite second end, a rear strap 108, which may be formed from webbing, strapping, tether material, or other suitable materials, as known to those of skill in the art, may be attached to the linear section 106. The rear strap 108 may be used to secure the system to a rifle R at a second end, as by insertion through a suitable mounting structure on the rifle R and secured back to itself using a strap slide 107 or other structure.

Figure 3:
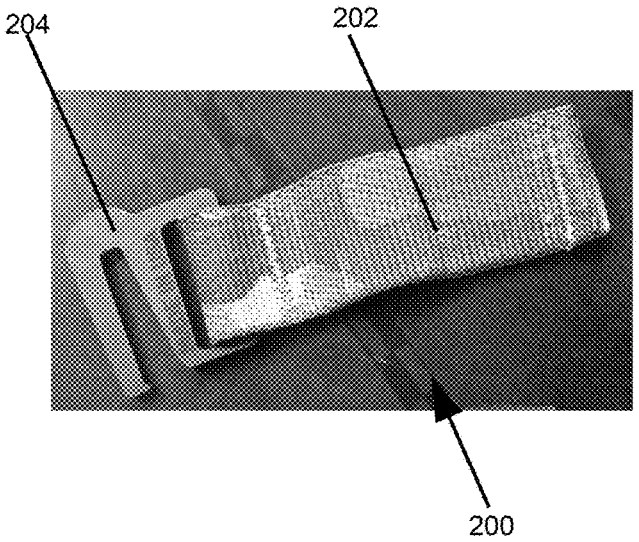
FIG. 3 illustrates a side view of a capture assembly for the system of FIGS. 1 and 2.
Figure 2:
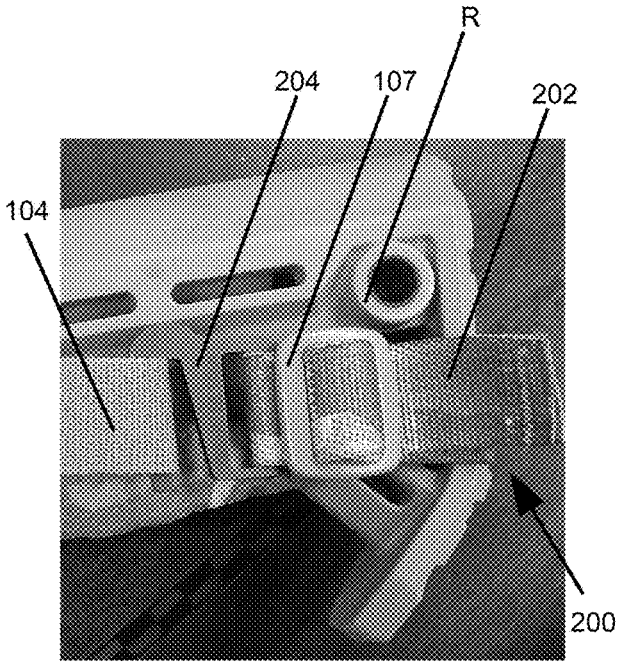
FIG. 2 is an enlarged side view of the rear portion of the sling system of FIG. 1.
Figure 4:
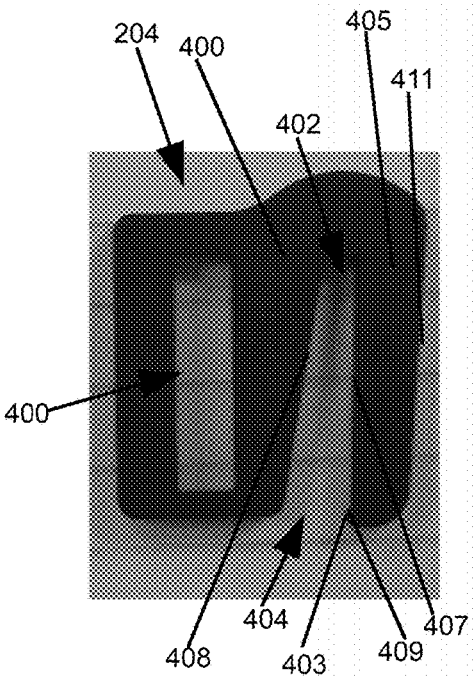
FIG. 4 illustrates a side view of the capture buckle of the capture assembly of FIG. 3.

As depicted in additional detail in FIGS. 2 and 3, a capture assembly 200 may be disposed adjacent the rear strap 108. Capture assembly 200 may include a capture buckle 204 and a connection strap 202 attached thereto. The capture buckle 204 of FIGS. 1A through 3 is depicted in isolation in FIG. 4.

Capture buckle 204 may be formed as a generally planar member with an opposite front surface 205 and back surface. A connection port 400 may be formed as a first opening sized and configured for a sling, strap, webbing, band or tether to attach or interface with the buckle. The front and/or back planar surfaces may include knurling or other textural features to assist in retaining the strap 108 in a secured position. As depicted in FIGS. 1A through 3, connection strap 202 may pass through the connection port 400 and secured therein, as by sewing, clasp or banded to itself. As depicted in FIGS. 1A through 2, the connection strap 202 may be secured to the rear strap 108 by the strap slide 107. In other embodiments, the connection strap 202 may be secured to the rear strap 108 by sewing, by a tri-bar slide or as is otherwise known in the art.

An open bottom capture port 402 may be formed as a second opening sized and configured for a sling, strap, webbing, band or tether to attach or interface with the capture buckle 204. Capture port 402 may be configured as an open loop interface with an angled geometry from the closed top to a larger bottom opening 404. As depicted, the medial sidewall 408 may angle inwardly with respect to the buckle body as it extends downwards to the open bottom 404.

The lateral sidewall 407 of the open bottom port 402 and outer sidewall 411 of the capture buckle 202 define the "capture member" 405 for securing the adjustable loop 104 in the secured conformation. In the depicted embodiment, the capture member 405 has an upper retaining portion where lateral sidewall 407 has a planar surface that extends downwardly towards the bottom opening 404 and is sized and configured to retain the strap 108 thereon in the secured position. Beginning at a transition point 409, a guide portion 403 of the capture member is defined where the lateral sidewall has a planar inner surface with a decreased slope. Importantly, while the slope of the guide portion is decreased, the guide portion continues to smoothly slope towards the open bottom. Thus, the transition point and guide portion facilitate sliding movement of the strap across the upper retaining portion as the strap loop 104 is tightened to the secured position by increasing friction there across. However, the continued slope to the open bottom, and smooth surface, does not impair quick release of the strap 108, as discussed further herein, especially in comparison to a buckle that includes a retaining "hook" on the capture member.

Figure 5A:
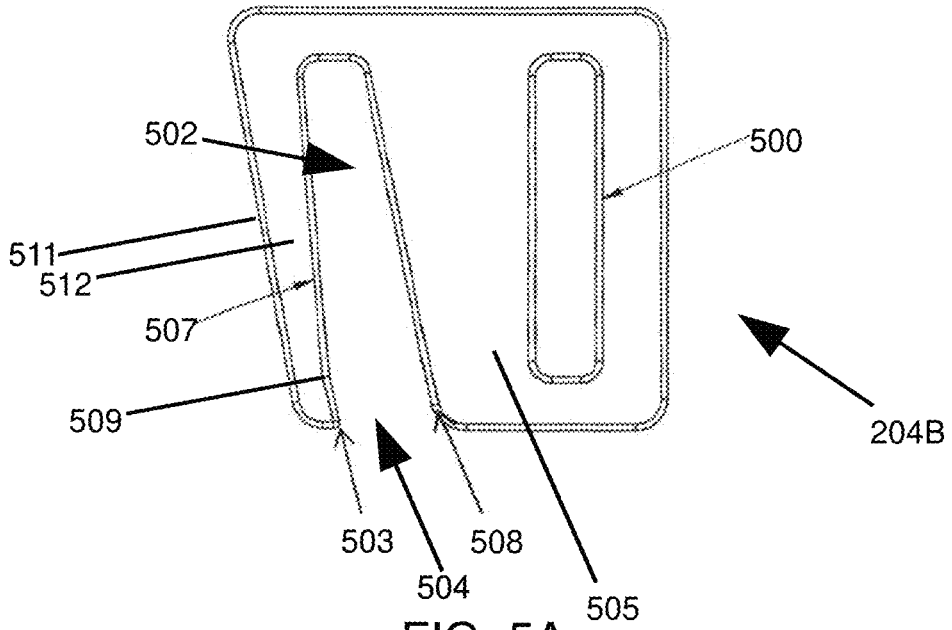
FIGS. 5A and 5B are side and perspective views, respectively of another implementation of a capture buckle for a capture assembly made in accordance with the teachings and principles of the disclosure.
Figure 5B:
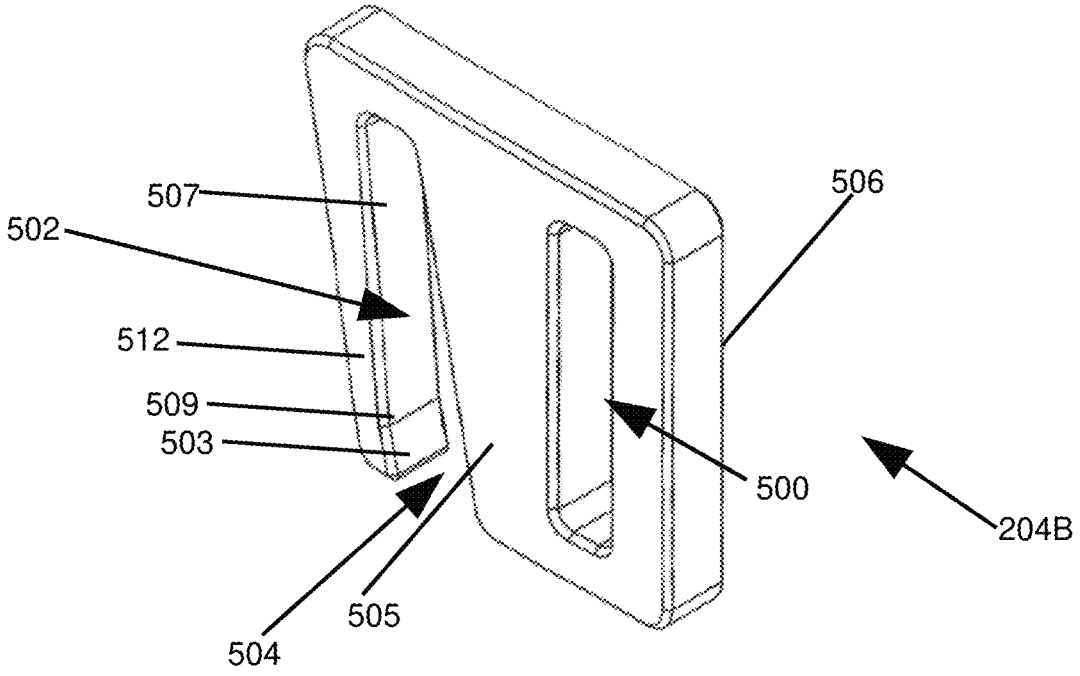

FIGS. 5A and 5B, depict another exemplary capture buckle 204B, which similarly be formed as a generally planar member with an opposite front surface 505 and back surface 506. A connection port 500 may be formed as a first opening sized and configured for a sling, strap, webbing, band or tether to attach or interface with the buckle. The front and/or back planar surfaces may include knurling or other textural features to assist in retaining the strap 108 in a secured position on the capture member 505. A connection strap 202 may pass through the connection port 500 and secured therein for connection to the system 10, as discussed in connection with FIG. 4.

An open bottom capture port 502 may be formed as a second opening sized and configured for a sling, strap, webbing, band or tether to attach or interface with the capture buckle 204B. Capture port 502 may be configured as an open loop interface with an angled geometry from the closed top to a larger bottom opening 504. As depicted, the medial sidewall 508 may angle inwardly with respect to the buckle body as it extends downwards to the open bottom 504.

The lateral sidewall 507 of the open bottom port 502 and outer sidewall 511 of the capture buckle 204B define the "capture member" 512 for securing the adjustable loop 104 in the secured conformation. In the depicted embodiment, the capture member 512 has an upper retaining portion where lateral sidewall 507 has a planar surface that extends from and "upwards" position near the closed top of capture port 502 "downwards" towards the bottom opening 504 and is sized and configured to retain the strap 108 thereon in the secured position. Beginning at a transition point 509, a guide portion 503 of the capture member is defined where the lateral sidewall has a planar inner surface with a decreased slope. In the exemplary embodiments, while the slope of the guide portion is decreased, the guide portion continues to smoothly slope towards the open bottom.

Systems and apparatus in accordance with the present disclosure provide for methods and processes that are unique and advantageous for use by security personnel, such as police officers and soldiers. For example, a sling system 10 allows a weapon to be stored or transported with the sling in a secured position and then rapidly deployed for use. In order to facilitate storage or transport, a sling system in accordance with the present disclosure may be attached to a weapon. The sling may then be secured by looping a section of the strap or webbing in the open interface of the capture device and tensioning it therein to tightly secure the system against the rifle or tool in a secured position. The weapon with secured sling can then be stored or transported in a storage rack.

In a situation where a user, such as a law enforcement officer, soldier, guard, or the like, needs to access the weapon, the user may remove the weapon form the storage rack. The secured sling remains out of the way eliminating snagging or catching. When the user needs to use the sling, they loosen the loop, as by manipulating the speed buckle. After the loop is slightly loosened, the secured portion can exit the open interface rapidly, with the webbing sliding from the retaining portion to the guide position, as the sling is deployed.

It will be appreciated that in addition to being used for weapons, sling systems in accordance with the present invention may be used on bags, tools, cases, and any other items for which a sling may be useful. Additionally, it will be appreciated that a system in accordance with the present system may be created using different sling designs in connection with a capture assembly, including a capture buckle and a connection strap, as discussed previously herein.

In the foregoing Detailed Description, various features of the disclosure are grouped together in a single implementation for streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A rapid deployment sling system comprising:

an adjustable sling having a first end and a second end, the adjustable sling further comprising at least one portion formed as an adjustable loop between the first end and the second end that may be increased or decreased in size to lengthen or shorten the adjustable sling for use; and a sling securing assembly comprising a capture device, wherein the capture device comprises a device body having a first planar surface and an opposite parallel second planar surface, at least a first attachment interface for a strapping material formed as a first slot passing through the device body from the first planar surface to the second planar surface and is defined by surrounding sidewalls, at least a first securing interface formed as a second slot passing through the device body from the first planar surface to the second planar surface and an opening through a side surface of the device body to define a capture member between the second slot and a second side surface of the device body, such that when the capture member is placed in the adjustable loop, and the adjustable loop decreased in size, the loop is retained on the capture member, and a securing strap attached to the capture device, and wherein the capture member defines a retention zone where the inner sidewall of the capture member has a relative constant first slope in relation to the device body along its length from a point near the closed end to a transition point towards the opening through the side surface, and a guide zone where the inner sidewall of the capture member differs in slope in relation to the device body from the first slope along its length from the transition point to the opening through the side surface and the guide zone has a relatively constant slope along its length from the transition point to the opening through the side surface and the inner sidewall of the capture member in the guide zone has a relatively smooth surface that facilitates slidable movement of securing strap off the capture member and out the opening through the side surface.

2. The system of claim 1, wherein the securing strap attaches the capture device to the second end of the adjustable sling.

3. The system of claim 1, wherein the adjustable sling further comprises a speed buckle for adjusting the size of the adjustable loop.

4. The system of claim 1, wherein the adjustable loop is constructed from webbing or strapping.

5. The system of claim 1, wherein the least first securing interface for a strapping material is formed as a slot with an angled geometry from a having a relatively narrower portion at a closed end to a relatively larger portion towards the opening through the side surface of the device body.

6. The system of claim 1, wherein the capture member includes a surface feature to increase friction on the first planar surface of the device body.

7. A securing assembly for an adjustable strap, comprising:

a capture device, wherein the capture device comprises a device body having a first planar surface and an opposite parallel second planar surface, at least a first attachment interface formed as a first slot passing through the device body from the first planar surface to the second planar surface and defined by surrounding sidewalls, at least a first securing interface formed as a second slot passing through the device body from the first planar surface to the second planar surface and an opening through a side surface of the device body to define a capture member between the second slot and a second side surface of the device body, such that when the capture member is placed in a loop of an adjustable strap, and the loop decreased in size, the strap is retained on the capture member, and wherein the capture member defines a retention zone where an inner sidewall of the capture member has a relative constant first slope in relation to the device body along its length from a point near the closed end to a transition point towards the opening through the side surface, and a guide zone where the inner sidewall of the capture member differs in slope in relation to the device body from the first slope along its length from the transition point to the opening through the side surface and the guide zone has a relatively constant slope along its length from the transition point to the opening through the side surface and the inner sidewall of the capture member in the guide zone has a relatively smooth surface that facilitates slidable movement of the adjustable strap off the capture member and out the opening through the side surface, and a securing strap attached to the capture device through the at least first attachment interface.

8. The assembly of claim 7, wherein the least first securing interface for a strapping material is formed as a slot with an angled geometry from a having a relatively narrower portion at a closed end to a relatively larger portion towards the opening through the side surface of the device body.

9. The assembly of claim 7, wherein the capture member includes a surface feature to increase friction on the first planar surface of the device body.

* * * * *